US007207861B2

(12) United States Patent
Martini

(10) Patent No.: US 7,207,861 B2
(45) Date of Patent: Apr. 24, 2007

(54) CUSHIONED UNDERWIRE

(75) Inventor: Jeanne Martini, Brooklyn, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 104 days.

(21) Appl. No.: 10/953,736

(22) Filed: Sep. 29, 2004

(65) Prior Publication Data

US 2005/0124261 A1 Jun. 9, 2005

Related U.S. Application Data

(60) Provisional application No. 60/506,832, filed on Sep. 29, 2003.

(51) Int. Cl.
*A41C 3/10* (2006.01)
*A41C 3/14* (2006.01)
*A41C 3/12* (2006.01)

(52) U.S. Cl. ..... 450/49; 450/41; 450/47; 450/52

(58) Field of Classification Search ..... 450/41, 450/45, 47–49, 51, 52, 60–62; 2/255, 256, 2/258–261, 263
See application file for complete search history.

(56) References Cited

U.S. PATENT DOCUMENTS

| | | | | |
|---|---|---|---|---|
| 911,204 | A | 2/1909 | Busby | |
| 1,288,927 | A | 12/1918 | Kops | |
| 1,290,608 | A | 1/1919 | Lowman | |
| 1,670,684 | A | 5/1928 | Leuchtag | |
| 1,804,855 | A | 5/1931 | Bollwine | |
| 1,875,201 | A | 8/1932 | Weber | |
| 2,266,518 | A | 12/1941 | Lutfy | |
| 2,327,488 | A | 8/1943 | Becker | |
| 2,497,938 | A | 2/1950 | Werther | |
| D161,439 | S | 1/1951 | Glick | |
| 2,630,572 | A | 3/1953 | Gluckin et al. | |
| 2,688,748 | A | 9/1954 | Mack | |
| 2,715,225 | A | 8/1955 | Gould | |
| 2,760,199 | A | 8/1956 | Champagne | |
| 2,762,052 | A | 9/1956 | Olsen | |
| 2,794,986 | A | 6/1957 | Milo | |
| 2,800,659 | A | 7/1957 | Hazard | |
| 2,800,902 | A | 7/1957 | Wiltrout | |
| 2,866,462 | A | 12/1958 | Faron | |
| 2,882,905 | A | 4/1959 | Barg | |
| 2,888,931 | A | 6/1959 | Schaumer | |
| 2,949,115 | A | 8/1960 | Phillips | |
| 3,040,750 | A | 6/1962 | Hurwitz | |
| 3,605,753 | A * | 9/1971 | Schwartz | 450/52 |
| 4,741,719 | A | 5/1988 | Wirth | |
| 4,770,650 | A * | 9/1988 | Rowell | 450/52 |
| 4,804,351 | A | 2/1989 | Raml | |

(Continued)

*Primary Examiner*—Gloria M. Hale
(74) *Attorney, Agent, or Firm*—Ohlandt, Greeley, Ruggiero & Perle, L.L.P.

(57) ABSTRACT

A cushioned underwire is cooperative with any of a variety of different brassieres having different width and size. The cushioned underwire is adjustable and positioned in a multi-layered casing, which is connected along a perimeter portion of the brassiere. The casing is connected to one or more layers of material used to form a breast cup portion of the brassiere. At least a portion of the casing is overlapped by a cushion and/or protective barrier. This cushion barrier provides both comfort and feminine allure.

19 Claims, 5 Drawing Sheets

U.S. PATENT DOCUMENTS 4,816,005 A 3/1989 Braaten
5,823,851 A 10/1998 Dicker
6,165,045 A 12/2000 Miller
6,190,232 B1 * 2/2001 Boser ..... 450/47
6,468,130 B1 * 10/2002 Thakur et al. ..... 450/41
D475,506 S 6/2003 Hoffman
D475,835 S 6/2003 Hoffman
6,682,395 B2 * 1/2004 Falla et al. ..... 450/41

* cited by examiner

CUSHIONED UNDERWIRE

CROSS REFERENCE TO RELATED PATENT APPLICATIONS

This application claims priority to U.S. Provisional Patent Application No. 60/506,832 filed on Sep. 29, 2003.

BACKGROUND OF THE INVENTION

1. Field of the Invention

The present invention relates to brassieres. More particularly, the present invention relates to cushioned underwires for brassieres.

2. Description of the Related Art

The use of underwire elements for shaping and supporting the lower periphery of brassiere or bra cups has long been known in the art. The term "underwire" has been in common use to refer to such elements. An underwire can take any of a number of forms such as, for example, a pair of metal U-shaped wire frames corresponding with a pair of bra cups, respectively. Alternatively, an underwire can be a single integral wire frame that traverses both bra cups. These various underwires are typically formed from metal or some other relatively rigid material like a plastic or a polymeric material.

The conventional purpose of these underwire frames is to provide support for the bust while being flexible enough to conform easily to the wearer's body for appearance. The drawbacks associated with conventional underwire frames are that they can wear through the material of a brassiere over time and cause damage to the clothing of the wearer, they must be individually shaped to comfortably correspond to the extent of the wear's bust, and the relative stiffness, and may provide discomfort and lack of adaptability to the needs of various users.

In light of the foregoing, there is an ongoing need for underwires or underwire frames that are comfortable to wear, resilient, and adequately support the breasts of the wearer.

SUMMARY OF THE INVENTION

It is an object of the present invention to provide a cushioned underwire that overcomes the above noted drawbacks.

It is another object of the present invention to provide a cushioned underwire that provides improved comfort, support, and feminine allure.

It is still another object of the present invention to provide a cushioned underwire that avoids having a thick appearance and/or a stiff, rigid feel.

It is yet another object of the present invention to provide a cushioned underwire that is adjustable and therefore can be used in a number of different sized brassieres.

It is a further object of the present invention to provide a cushioned underwire structure that can be conveniently assembled in the brassiere.

These and other objects and advantages of the present invention are achieved by one or more cushioned underwires that are suitable for cooperating with a variety of different brassieres having different width and size. The one or more underwires preferably have one or more adjustable ends. The underwires are preferably positioned in a multi-layered casing, which can be connected along a perimeter portion of any of a variety of brassieres. The casing may be connected to one or more layers of material used to form a breast cup portion of the brassiere. At least a portion of the casing is overlapped by a cushion and/or protective barrier. This barrier preferably improves both comfort and feminine allure.

BRIEF DESCRIPTION OF THE DRAWINGS

Other and further objects, advantages and features of the present invention will be understood by reference to the following specification in conjunction with the accompanying drawings, in which like reference characters denote like elements of structure.

DETAILED DESCRIPTION OF THE INVENTION

Figure 1:
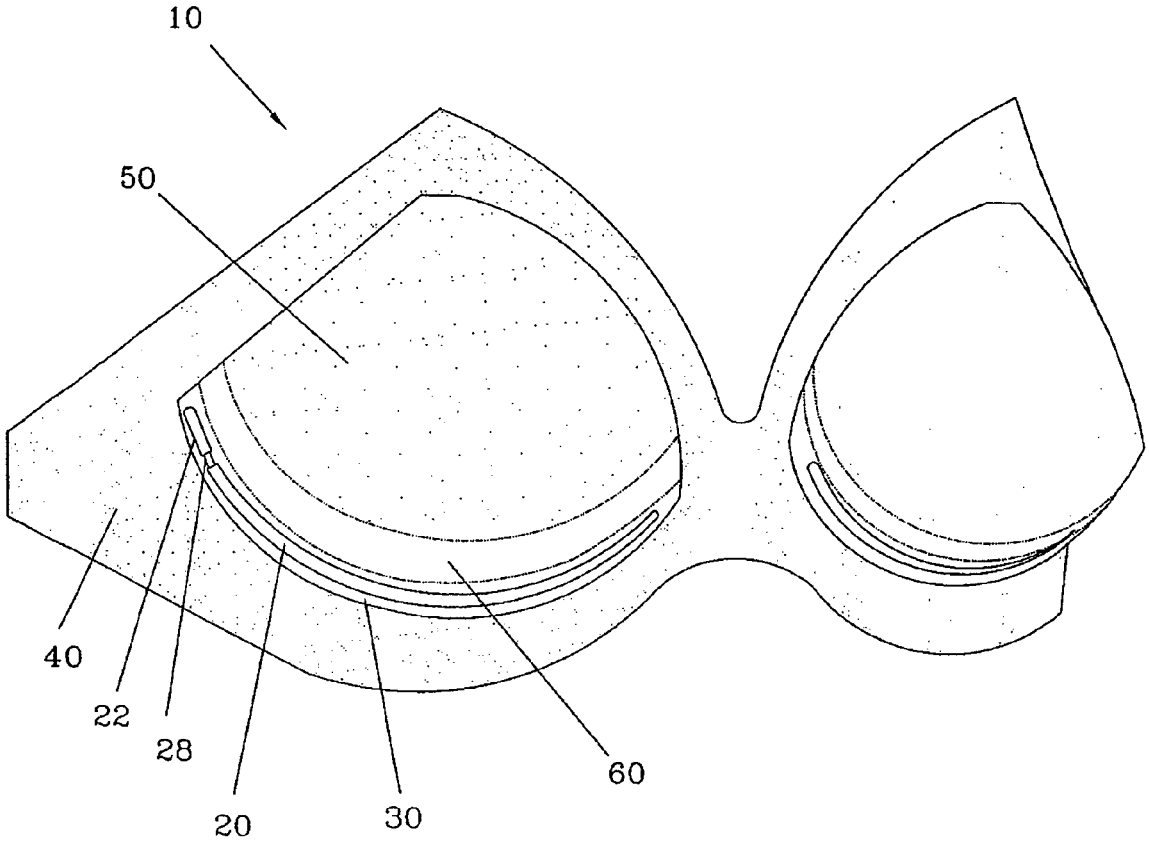
FIG. 1 is a front perspective view of a brassiere in accordance with an illustrative embodiment of the present invention.

Referring to the drawings and, in particular to FIG. 1, there is provided a brassiere in accordance with an illustrative embodiment of the present invention generally represented by reference numeral 10. As shown in an aspect of the present invention, one or more underwires 20, preferably suitable for cooperating with any of a variety of different brassieres, are positioned in a casing 30.

Casing 30 is operatively connected to brassiere 10 along a perimeter portion 40 thereof, and/or preferably, in close association with one or more breast cup portions 50 of brassiere 10.

In a preferred aspect of the invention, a cushion barrier 60 is cooperative with casing 30. The term cooperative is intended to mean that barrier 60 can be separably connected with casing 30 and/or brassiere 10, integrally formed with casing 30 and/or brassiere 10, or otherwise operatively connected with casing 30 and/or brassiere 10 to provide at least the intended effects discussed herein.

Figure 2:
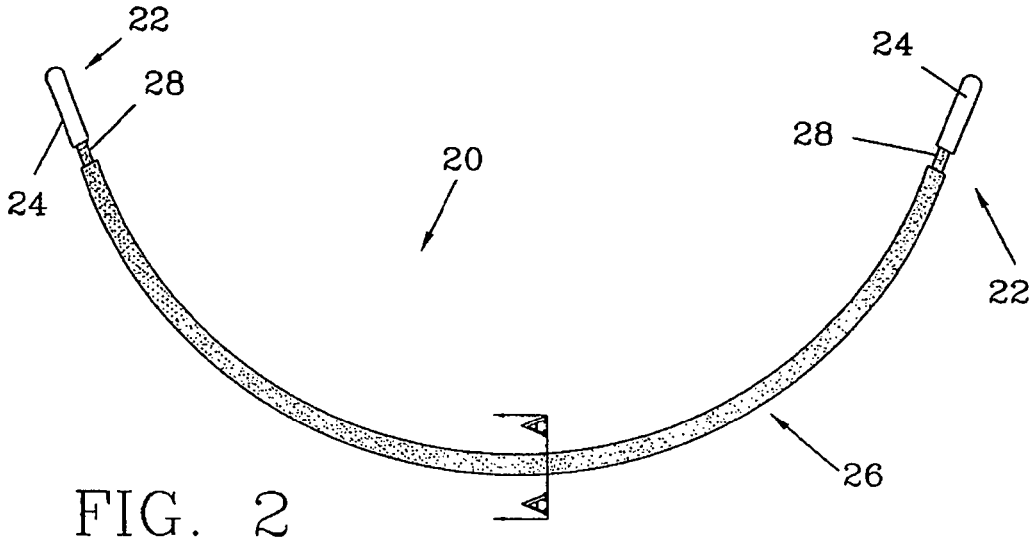
FIG. 2 is a plan view of an underwire in accordance with an illustrative embodiment of the present invention.

In one aspect of the present invention shown in FIG. 2, each underwire 20 is preferably arcuately curved and may be formed from a spring metal, a resilient plastic, or any other like pliant material, and/or any combination of the same.

As reflected, each underwire 20 is preferably thin with two substantially flat major surfaces sized and/or configured to be unobtrusive.

Figure 2A:
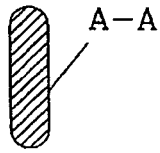
FIG. 2A is a cross-sectional view of the underwire of FIG. 2 along section line A—A.

That is, each underwire 20, in this aspect of the invention, preferably has a smooth, substantially flat rectangular cross-section such as that shown in FIG. 2A. Other forms/configurations may also be used.

Preferably, each end 22 and/or the entire length of one or more underwires 20 may be encased in a cap or sheath 24. The sheath 24 is formed of a relatively soft, smooth and/or flexible material. Such a material can be a plastic or elastomeric material, to increase comfort during wear and/or for durable protection against damage to casing 30 and/or brassiere 10. Each underwire 20 is preferably connected or secured in casing 30 in any suitable way (e.g., gluing, sewing, stitching, etc.). Underwires 20 preferably operate to support, to uplift and/or to otherwise bias a wearer's breasts.

Referring now to FIGS. 3 and 3A to 3C, in another aspect of the present invention, underwires 20 are provided with a variable cross-section. As shown, each underwire 20 may have a variable substantially ovular cross section with two softly curved primary surfaces. In this aspect of the invention, each underwire 20 preferably has a smooth, ovular cross-section that varies in orientation along the extent or length thereof. For example, one or more first portions, preferably at ends 22 of each underwire 20, can have a first orientation such as that shown in FIGS. 3A and 3C, and one or more second portions, preferably along a central portion 26 of each underwire 20, can have a second orientation such as that shown in FIG. 3B (e.g., rotated ninety degrees from the first orientation). This aspect of the invention enables underwires 20 to be incorporated into any of a number of different sized brassieres and/or preferably to comfortably conform and/or accommodate a variety of differently shaped breasts of relatively the same cup size. Other forms, configurations and/or orientations may also be used.

Figure 3:
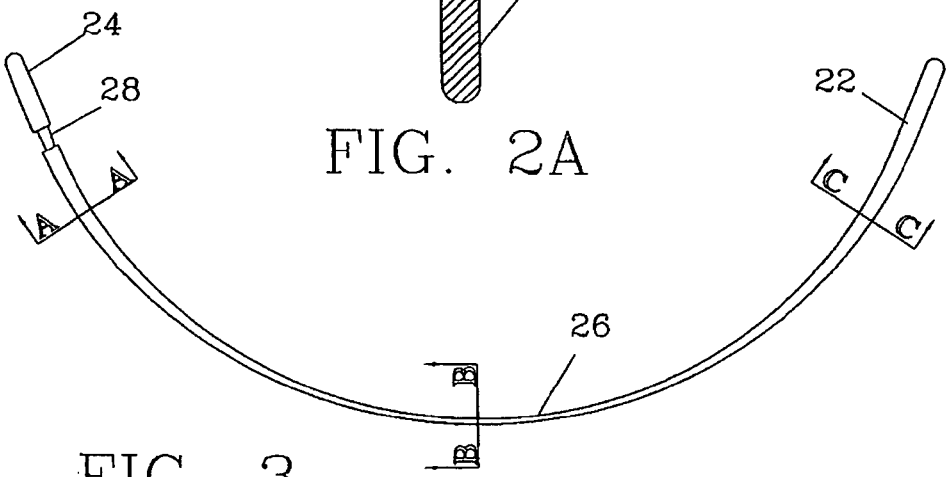
FIG. 3 is a plan view of an alternative underwire in accordance with another illustrative embodiment of the present invention.
Figure 3A:
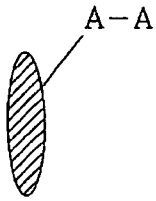
FIG. 3A is a cross-sectional view of the underwire of FIG. 3 along section line A—A, showing the cross-section at a first orientation.
Figure 3B:
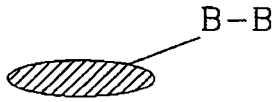
FIG. 3B is a cross-sectional view of the underwire of FIG. 3 along section line B—B, showing the cross-section at a second orientation.
Figure 3C:
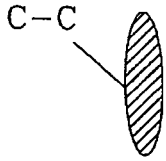
FIG. 3C is a cross-sectional view of the underwire strip of FIG. 3 along section line C—C, showing the cross-section at a third orientation substantially identical to the first orientation of FIG. 3A.

Referring to FIGS. 1, 2 and 3, in another aspect of the invention, cap or sheath 24 may cooperate with one or more underwires 20 via a flexible element 28 (e.g., a compression spring, a tension spring, a pivoting member, etc.}. Preferably, flexible element 28 enables each end 22 with which it is associated to move (e.g., longitudinally and/or laterally) in response to an interaction therewith or a force applied thereto. It is noted that other configurations are also foreseeable and within the scope of the present invention.

Figure 4:
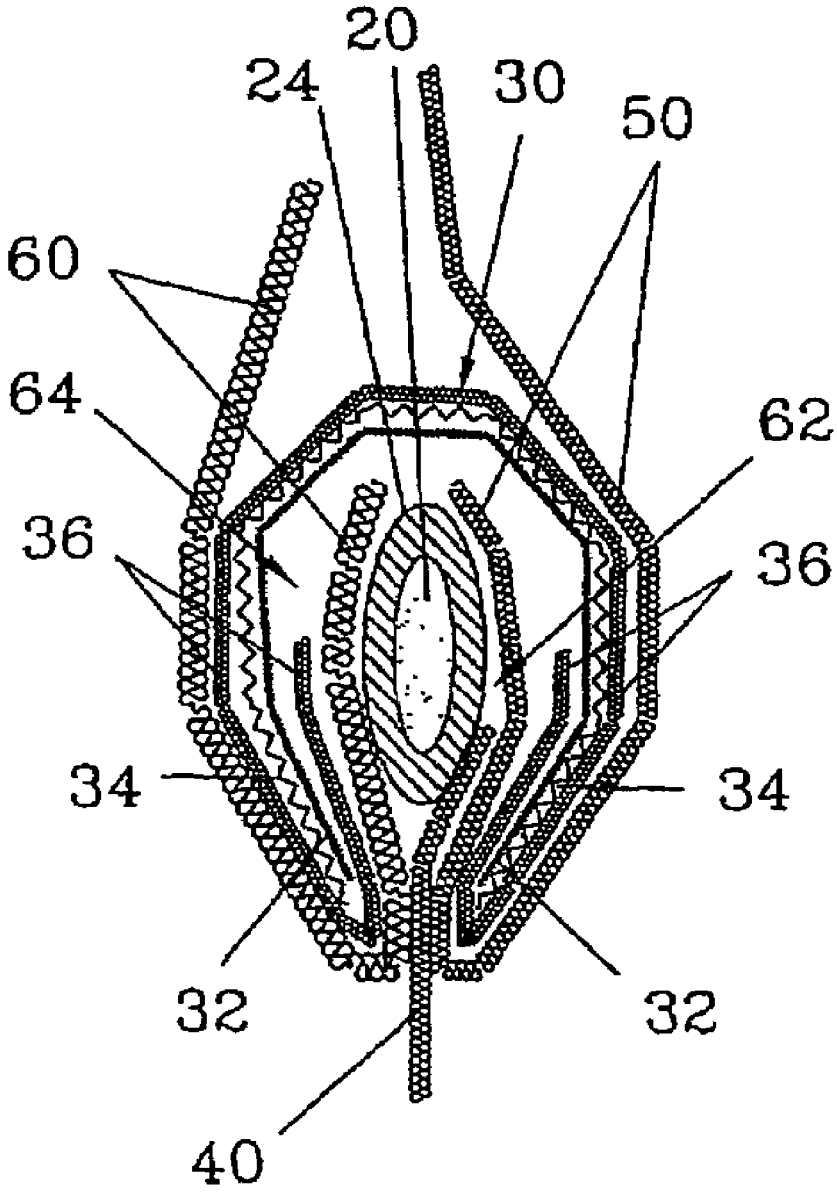
FIG. 4 is an enlarged side section view of the cushioned underwire in accordance with an illustrative embodiment of the present invention.

Referring now to FIG. 4, in the preferred aspect of the present invention, casing 30 is operatively connected with breast cup portion 50 and/or perimeter portion. Casing 30, in this aspect of the invention, preferably has three material layers, an inner layer 32, an intermediate layer 34, and an outer layer 36.

Inner layer 32 is preferably positioned on each underwire 20 to substantially surround one or more of underwires 20 and form an inner covering for the underwire. Inner layer 32 is preferably formed of a material suitable to minimize or eliminate any puncture of one or more underwires 20 through the various other material layers associated with casing 30 and/or brassiere. Inner layer 32 may be made of a non-woven, non-stretchable material, but need not be. Inner layer 32 is preferably lightweight such as, for example, a polyester ranging from about 5 ounces per square yard plus or minus ten percent. Most preferably, the inner layer 32 is a fabric material sold under the trade name of "Tietex". The puncture strength of inner layer 32 is minimally about 110 pounds per square inch. The tensile strength of inner layer 32 is minimally about 55 pounds. The preferred thickness of inner layer 32 falls in the range of about 0.53 millimeters to about 0.84 millimeters.

Intermediate layer 34 is preferably positioned between inner layer 32 and outer layer 36 to substantially surround one or more underwires 20 to form an intermediate covering for the underwire. Intermediate layer 34 is preferably formed of a material suitable to minimize or eliminate any puncture of one or more underwires 20 through the various other material layers associated with casing 30 and/or brassiere 10 and to provide a cushioning effect. Intermediate layer 34 is a preferably a woven, non-stretchable material, but need not be. Intermediate layer 34 is preferably a lightweight material such as, for example, a nylon taffeta ranging from about 1.8 ounces per square yard to about 2.2 ounces per square yard. The tensile length of intermediate layer 34 is preferably minimally about 70 pounds, while the tensile width of intermediate layer 34 is preferably minimally about 60 pounds.

Outer layer 36 is preferably positioned around intermediate layer 34 and is folded to overlap at least a portion of itself, inner layer 32 and/or intermediate layer 34 to form casing 30. Outer layer 36 is preferably formed of a material suitable to provide a further cushioning effect. Outer layer 36 can be, as can both inner layer 32 and intermediate layer 34, formed from any of a variety of materials suitable to accomplish the stated function thereof. Most preferably, the outer layer 36 is formed from a suitable Tafetta fabric material. Alternatively, the outer layer 36 may be the same material or a different than the intermediate layer 34. Outer layer 36 may be made of varying combinations of material such as, for example, nylon in the range of about 78% to about 84% based on fabric content and/or spandex in the range of about 16% to about 22% based on fabric content. Preferably, outer layer 36 is lightweight, ranging from about 5 ounces per square yard to about 5.8 ounces per square yard. The tensile length of outer layer is preferably at least 25 lbs., while the tensile width of outer layer 36 is at least 33 lbs. Breast cup portion 50 is preferably formed from one or more layers of material.

Each layer may have any of a variety of desirable characteristics associated therewith (e.g., lofted, elastomeric, alluring, etc.). Each layer need not have the same construction or form. Each layer can be discretely shaped, sized and/or configured to provide any of a variety of effects. Also, each layer, if desirable, can be positioned and/or secured, with respect to the other layers, only where essential to provide a desired effect (e.g., comfort, support, aesthetic allure, etc.).

Breast cup portion 50 is preferably moldable and suitable to provide any of a variety of stylistic effects, facilitate providing superior control, support and/or uplift as desired to enhance the feminine allure of the wearer's breast. Preferably, breast cup portion 50 may be fashioned using any known technique suitable or conventionally known for accomplishing such a task (e.g., via sewing, knitting, weaving, or molding, etc.).

It is noted that in other aspects of the invention, additional layers may also be provided. For example, a separate adhesive or bonding layer (not shown) can be used to fuse or bond the various cup layers together. This bonding layer can have elastic properties sufficient to compliment those associated with the materials used to form the breast cup portion. The bonding layer may be suitable for cooperating with a variety of textile and/or material forming techniques, including microfibers and/or specialized nonwovens. Perimeter portion 40, like breast cup portion 50, may also be formed from any of a variety of layers and/or materials. Each layer may have any of a variety of desirable characteristics associated therewith (e.g., lofted, elastomeric, alluring, etc.).

Each layer need not have the same construction or form. Each layer can be discretely shaped, sized and/or configured to provide any of a variety of effects. Also, each layer, if desirable, can be positioned and/or secured, with respect to the other layers, only where essential to provide a desired effect (e.g., comfort, support, aesthetic allure, etc.). Perimeter portion 40 is preferably moldable and suitable to provide any of a variety of stylistic effects, facilitate providing superior control, support and/or uplift as desired to enhance the feminine allure of the wearer's breast.

Preferably, perimeter portion 40 may be made using any known technique suitable or conventionally known for accomplishing such a task (e.g., via sewing, knitting, weaving, molding, etc.). As shown in FIG. 4, cushion barrier 60 of each breast cup portion is functionally connected to underwires 20 via casing 30, breast cup portion 50, and/or perimeter portion 40. As with breast cup portion 50 and/or perimeter portion 40, cushion barrier 60 may also be formed from any of a variety of layers and/or materials. Each layer may have any of a variety of desirable characteristics associated therewith (e.g., lofted, elastomeric, alluring, etc.). Each layer need not have the same construction or form. Each layer can be discretely shaped, sized and/or configured to provide any of a variety of effects. Also, each layer, if desirable, can be positioned and/or secured, with respect to the other layers, only where essential to provide a desired effect (e.g., comfort, support, aesthetic allure, etc.).

Cushion barrier 60 is preferably moldable and suitable to provide any of a variety of stylistic effects, facilitate providing superior control, support and/or uplift as desired to enhance the feminine allure of the wearer's breast. Cushion barrier 60 may be made using any known technique suitable or conventionally known for accomplishing such a task (e.g., via lamination, sewing, knitting, weaving, molding, etc.). Cushion barrier 60 preferably eliminates or reduces the thick appearance and/or the stiff, rigid feel often associated with that portion of the brassiere in which the underwire is positioned. Cushion barrier 60 may be positioned in various alternative locations in relation to underwires 20 via casing 30, breast cup portion 50, and/or perimeter portion 40. For example, cushion barrier 60 may be positioned so that it is opposite breast cup portion 50 with an underwire 20 and/or casing 30 positioned therebetween.

In another embodiment of the invention, the breast cup portion 50 can be folded to overlap itself and casing 30 so that at least a portion of casing 30 is not in contact with underwire 20 and at least a portion of breast cup portion 50 is in contact with the underwire. In still another embodiment, cushion barrier 60 can be folded to overlap itself and casing 30 so that at least a portion of casing 30 is not in contact with underwire 20 and at least a portion of cushion barrier 60 is in contact with the underwire.

Thus, breast cup portion 50 and cushion barrier 60 preferably cooperate to form both an inner pocket 62 and an outer pocket 64. Inner pocket 62 is preferably suitable to receive and enfold, and encompass underwire 20 and outer pocket 64 is preferably suitable to receive and encompass casing 30. It is noted that underwire 20, casing 30 and/or perimeter portion 40 can be operatively connected to breast cup portion 50 and/or cushion barrier 60 in any of a variety of ways and in any of a variety of positions relative to inner pocket 62 and/or outer pocket 64. Thus, cushion barrier 60 preferably cooperates with casing 30, breast cup portion 50 and/or perimeter portion 40 to form an intricate cushioned underwire suitable to accomplish the stated objectives of the present invention.

Having described some of the preferred aspects of the present invention the following is a preferred method for forming the cushioned support underwire. The first step is preferably to position casing 30 at least substantially about underwire 20. Next, casing 30 can subsequently or preferably simultaneously be connected or secured to breast cup portion 50 and perimeter portion 40. In turn, cushion barrier 60 is likewise simultaneously connected or secured to breast cup portion 50 and/or perimeter portion 40 in such a way so as to form an inner pocket and an outer pocket in which casing 30 and/or underwires 20 are positioned and/or encompassed. As shown in FIG. 4, the intermediate layer 34 may in one embodiment radially extend around an inner surface of the casing 30 as shown or alternatively only extend around a portion of the inner surface.

Figure 5:
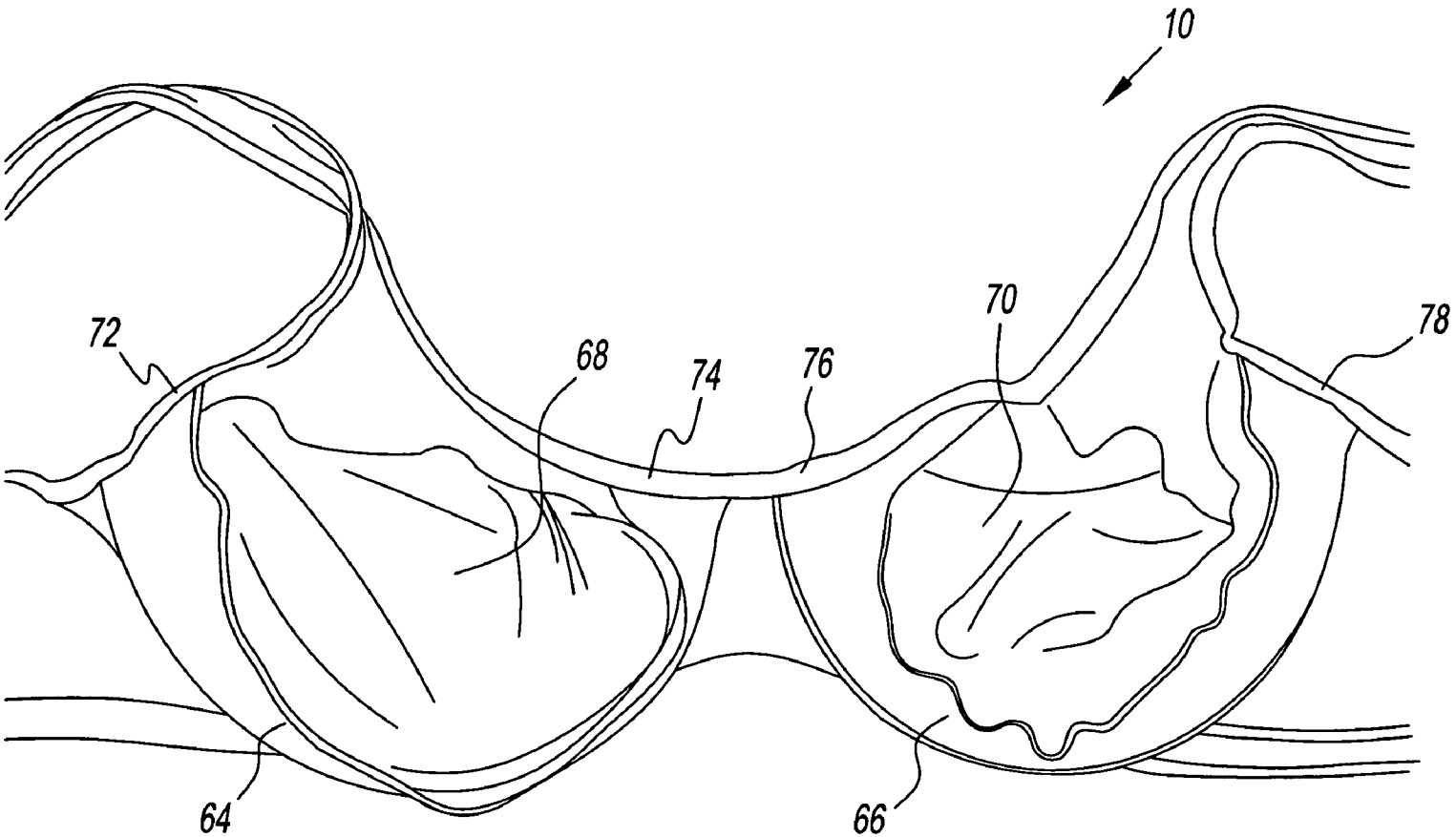
FIG. 5 is a rear view of the brassiere of FIG. 1 with a flap forming a sling.
Figure 6:
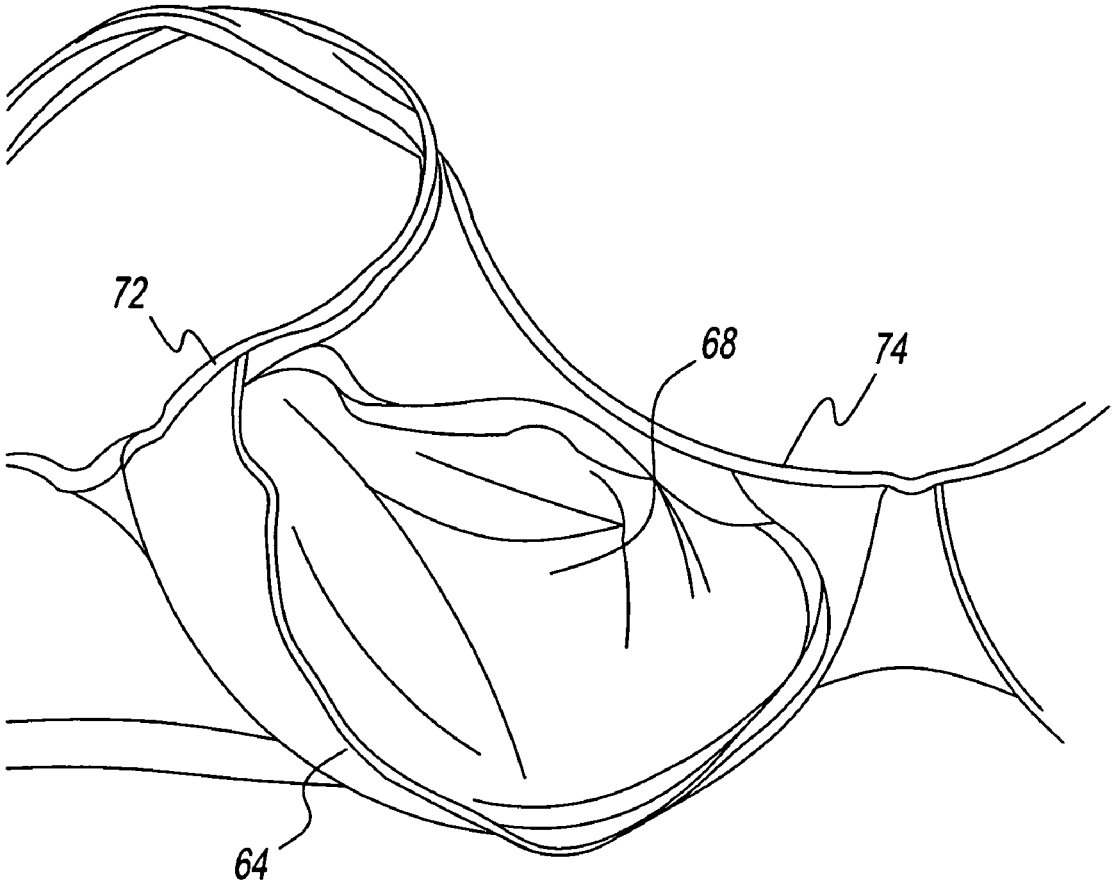
FIG. 6 is a rear close up view of a breast cup having the flap and sling of FIG. 5.

Referring to FIG. 5, there is shown a rear view of the brassiere 10. The brassiere 10 further has a looped strap structure connected to each breast cup portion 50 for cradling the breast tissue of the wearer and for increased comfort. The brassiere 10 preferably has a first flap 64, and a second flap 66 with the first flap 64 connected to a first breast cup 68 and the second flap 66 connected to a second breast cup 70. Preferably, each of the first flap 64 and the second flap 66 is a generally orthogonal shaped section of fabric that is connected at three sides of each breast cup. The first flap 64 is preferably connected by a stitching operation along a length of the first breast cup 68. Likewise, the second flap 66 also is connected along a length of the second breast cup 70 by a second stitching operation. The first flap 64 is further stitched to a first banding 72 on one front side and is also stitched to a second banding 74 on the opposite rear side. The second flap 66 is also stitched to a third banding 76 on the first front side and is stitched to a fourth banding 78 on the second side by another stitching operation. Referring to FIG. 6, there is shown a close up view of the first flap 64 of FIG. 5. The first flap 64 is disposed to be in a complementary location to a bottommost edge of the wearer's breast to form a sling type member when the breast is in the first breast cup 68.

In this manner, the first flap 64 preferably lends support under the wearer's breast and forms a pocket adjacent the first breast cup 68 for which the breast tissue may be inserted and comfortably rest thereon. Likewise, the second flap 66 forms a second pocket adjacent the other second breast cup 70 for additional support to the other of the wearer's pair of breasts. Preferably, each of the first flap 64 and the second flap 66 are made from the same or different material that forms the remainder of the brassiere. In one embodiment, the first flap 64 and the second flap 66 may be a combination of nylon and spandex, or more particularly, seventy six percent nylon and twenty-four percent spandex. Alternatively, the first flap 64 and the second flap 66 may be a cotton or composite material. However, one skilled in the art should appreciate that the outer surface of each of the first flap 64 and the second flap should be smooth and without any abrasive material to provide maximum comfort to the wearer.

The present invention having been thus described with particular reference to the preferred forms thereof, it will be obvious that various changes and modifications may be made therein without departing from the spirit and scope of the present invention as defined herein.

What is claimed is:

1. A brassiere comprising:

a breast cup;

an underwire;

a casing for encompassing the underwire, the casing being disposed on a lateral edge of the breast cup;

a cushion barrier cooperative with the casing;

wherein the casing comprises an intermediate layer between an inner layer and an outer layer, the outer layer being folded in on itself such that the outer layer is adjacent to at least a portion of both the intermediate layer and the inner layer.

2. The brassiere of claim 1, wherein the cushion barrier and a portion of the breast cup cooperate to form an inner pocket for encompassing the underwire, the inner pocket being surrounded by the casing.

3. The brassiere of claim 2, wherein the portion of the breast cup is folded to overlap itself and the casing such that at least a portion of the casing is not in contact with the underwire.

4. The brassiere of claim 2, wherein the cushion barrier is folded to overlap itself and the casing such that at least a portion of the casing is not in contact with the underwire.

5. The brassiere of claim 1, wherein the underwire is adjustable.

6. The brassiere of claim 5, wherein the underwire has spring ends.

7. The brassiere of claim 6, wherein the underwire has at least one end with a member connected to a spring at the end, the member moving from a first compressed position to a second extended position.

8. The brassiere of claim 1, wherein the underwire has a smooth, substantially flat rectangular cross-section.

9. The brassiere of claim 1, wherein the underwire has a substantially oval cross-section with two softly curved primary surfaces.

10. The brassiere of claim 1, wherein the underwire has a variable cross-section.

11. The brassiere of claim 10, wherein the variable cross-section varies only in orientation along the length of the underwire.

12. The brassiere of claim 10, wherein the underwire comprises a first end, a second end, and a central portion; the underwire having a first orientation at the first and second ends, and a second orientation at the central portion.

13. The brassiere of claim 11, wherein the second orientation is rotated ninety degrees from the first orientation.

14. A brassiere comprising:

a breast cup;

an underwire disposed on a lateral edge of the breast cup;

an inner layer substantially surrounding the underwire;

an intermediate layer substantially surrounding the inner layer;

an outer layer, substantially surrounding the intermediate layer, the outer layer being folded in on itself such that the outer layer is adjacent to at least a portion of both the intermediate layer and the inner layer;

a cushion barrier cooperating with a portion of the breast cup to substantially surround the outer layer;

wherein the cushion barrier and a portion of the breast cup cooperate to form an inner pocket for encompassing the underwire, the inner pocket being surrounded by the casing.

15. The brassiere of claim 14, wherein the cushion barrier is folded to overlap itself such that it sandwiches at least a portion of the inner layer, the intermediate layer, and the outer layer.

16. The brassiere of claim 15, wherein the portion of the breast cup is folded to overlap itself such that it sandwiches a different portion of the inner layer, the intermediate layer, and the outer layer.

17. The brassiere of claim 14, further comprising a flap connected to the lateral edge of the breast cup and forming a pocket adjacent to the breast cup.

18. The brassiere of claim 14, wherein the inner layer comprises a polyester material.

19. The brassiere of claim 14, wherein the outer layer comprises a nylon taffeta material.

* * * * *